US009449565B2

(12) United States Patent
Pyun et al.

(10) Patent No.: US 9,449,565 B2
(45) Date of Patent: Sep. 20, 2016

(54) DISPLAY DEVICE AND DRIVING METHOD THEREOF

(71) Applicant: Samsung Display Co., Ltd., Yongin (KR)

(72) Inventors: Ki Hyun Pyun, Gwangmyeong-si (KR); Sung-Jun Kim, Cheonan-si (KR); Jong-Young Yun, Gwangmyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 24 days.

(21) Appl. No.: 14/449,874

(22) Filed: Aug. 1, 2014

(65) Prior Publication Data

US 2015/0206499 A1 Jul. 23, 2015

(30) Foreign Application Priority Data

Jan. 20, 2014 (KR) ..... 10-2014-0006904

(51) Int. Cl.
*G09G 3/00* (2006.01)
*G09G 3/36* (2006.01)

(52) U.S. Cl.
CPC ..... *G09G 3/3611* (2013.01); *G09G 2310/08* (2013.01); *G09G 2330/04* (2013.01)

(58) Field of Classification Search
CPC ..... G09G 3/30; G09G 5/02; G09G 5/00; G09G 3/32; G09G 3/14; G09G 3/36; G09G 3/038
See application file for complete search history.

(56) References Cited

U.S. PATENT DOCUMENTS

| | | | | |
|---|---|---|---|---|
| 7,145,358 | B2 | 12/2006 | Ando | |
| 8,487,924 | B2 | 7/2013 | Jin et al. | |
| 2011/0193830 | A1 | 8/2011 | Cho | |
| 2012/0032938 | A1* | 2/2012 | Park | G09G 3/3208 345/211 |
| 2012/0127213 | A1 | 5/2012 | Park | |
| 2012/0256897 | A1* | 10/2012 | Seo | G09G 3/006 345/212 |
| 2012/0293562 | A1 | 11/2012 | Park | |

FOREIGN PATENT DOCUMENTS

| | | |
|---|---|---|
| KR | 1020080041842 | 5/2008 |
| KR | 1020120023378 | 3/2012 |

* cited by examiner

*Primary Examiner* — Michael Faragalla
(74) *Attorney, Agent, or Firm* — H.C. Park & Associates, PLC

(57) ABSTRACT

A display device includes: a plurality of pixels; a scan driver configured to apply a scan signal to a plurality of scan lines connected to the plurality of pixels; a data driver configured to apply a gray voltage to a plurality of data lines connected to the plurality of pixels; a signal controller configured to transmit a scan control signal for controlling operating of the scan driver to the scan driver, and configured to transmit a data control signal for controlling operating of the data driver to the data driver; a power supply configured to supply a power voltage for generation of the scan signal to the scan driver; and a short detector configured to detect a voltage level of the power voltage and generate an enable signal in response to the detection.

20 Claims, 5 Drawing Sheets

DISPLAY DEVICE AND DRIVING METHOD THEREOF

CROSS-REFERENCE TO RELATED APPLICATION

This application claims priority from and the benefit of Korean Patent Application No. 10-2014-0006904, filed on Jan. 20, 2014, which is hereby incorporated by reference for all purposes as if fully set forth herein.

BACKGROUND

1. Field

Exemplary embodiments of the present invention relate to a display device and a driving method thereof. More particularly, exemplary embodiments of the present invention relate to a display device that can decrease incidence of malfunction due to a short circuit of wiring, and a method for driving the same.

2. Discussion of the Background

A display device, such as a liquid crystal display (LCD), an organic light emitting diode display, and the like, includes a plurality of scan lines and a plurality of data lines connected to a plurality of pixels. The plurality of pixels is formed at crossing points of the scan lines and the data lines.

When a scan signal of a gate-on voltage is sequentially applied to the plurality of scan lines, a data signal is applied to the plurality of data lines corresponding to the scan signal of the gate-on voltage such that image data is written into the plurality of pixels.

The scan signal is formed by combination of the gate-on voltage and the gate-off voltage. At least one clock signal and a power voltage are required for generation of the scan signal. The at least one clock signal and the power voltage are applied to a scan circuit generating the scan signal through the respective wiring.

The wires are disposed adjacent to each other to decrease an unnecessary area, and a short circuit may occur between the wires during a manufacturing process or in use of the display device. When a short circuit occurs between wires, an excessive amount of current flows to the wire and thus heat generated due to the excessive current may cause damage to the circuit.

In particular, when the short circuit occurs between wires of the power voltage and the clock signal, particularly, 5 times the current of more flows to the wire of the power voltage so that the wires of the power voltage and the wire of the clock signal may ignite due to the excessive current.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a display device that can decrease incidence of malfunction due to a short circuit of wiring, and a method for driving the same.

Additional features of the invention will be set forth in the description which follows, and in part will be apparent from the description, or may be learned by practice of the invention.

An exemplary embodiment of present invention provides a display device, including: a plurality of pixels; a scan driver configured to apply a scan signal to a plurality of scan lines connected to the plurality of pixels; a data driver configured to apply a gray voltage to a plurality of data lines connected to the plurality of pixels; a signal controller configured to transmit a scan control signal for controlling operating of the scan driver to the scan driver, and configured to transmit a data control signal for controlling operating of the data driver to the data driver; a power supply configured to supply a power voltage for generation of the scan signal to the scan driver; and a short detector configured to detect a voltage level of the power voltage and generate an enable signal in response to the detection.

An exemplary embodiment of present invention also provides a method for driving a display device, including: receiving a power voltage for generating a scan signal applied to a plurality of scan lines connected to a plurality of pixels; generating an output voltage corresponding to a voltage difference between the power voltage and a reference voltage; controlling the switching transistor according to the output voltage; and transmitting a voltage of a first node between the switching transistor and an enable voltage as an enable signal to at least one of a power supply configured to generate the power voltage and a signal controller configured to control operating of the scan.

According to the exemplary embodiments, ignition of wires of the power voltage and the clock voltage due to a short circuit between the wires can be mitigated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
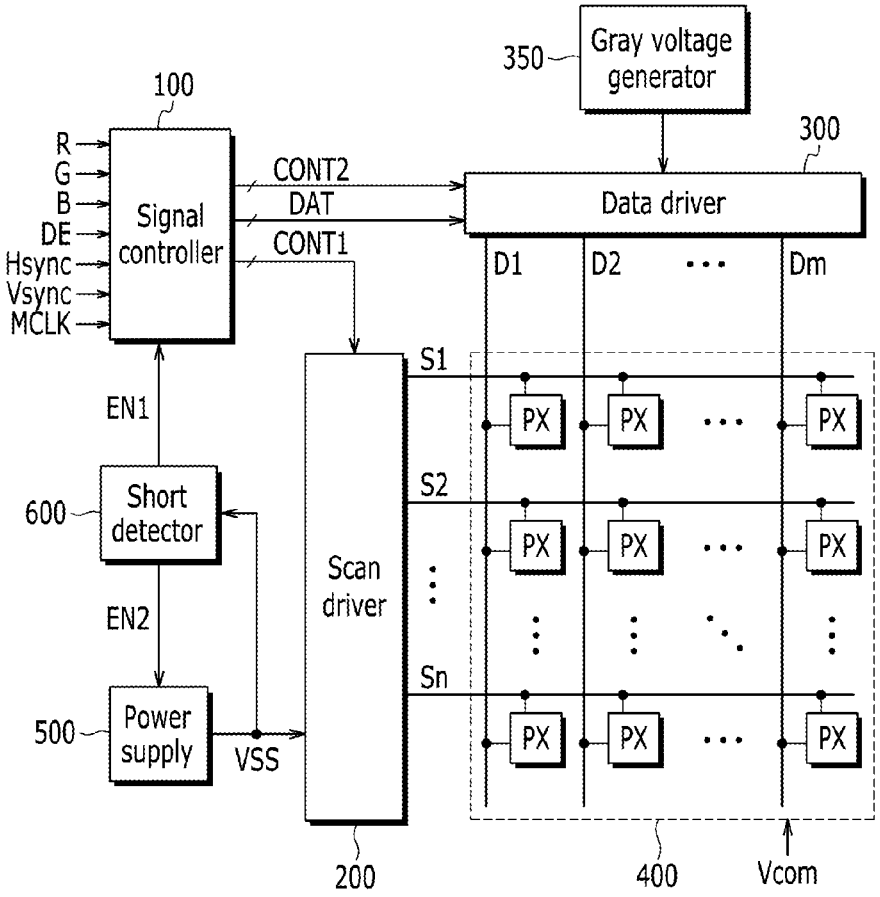
FIG. 1 is a block diagram of a display device according to an exemplary embodiment of the present invention.

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in exemplary embodiments, since like reference numerals designate like elements having the same configuration, a first exemplary embodiment is representatively described, and in other exemplary embodiments, only different configurations from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram of a display device according to an exemplary embodiment of the present invention.

Referring to FIG. 1, the display device includes a signal controller 100, a scan driver 200, a data driver 300, a gray voltage generator 350, a display unit 400, a power supply 500, and a short detector 600.

The display unit 400 includes a plurality of scanning lines S1 to Sn, a plurality of data lines D1 to Dm, and a plurality of pixels PX. Each of the plurality of pixels PX is respectively connected with a plurality of signal lines and arranged substantially in a matrix format. The plurality of scanning lines S1 to Sn are substantially extended in a row direction and are almost or generally parallel with each other. The plurality of data lines D1 to Dm are substantially extended in a column direction and are almost or generally parallel with each other.

The display unit 400 may be a liquid crystal panel assembly, and the liquid crystal panel assembly includes a thin film transistor display panel 10 (refer to FIG. 2), a common electrode display panel 20 (refer to FIG. 2) opposing the thin film transistor array panel 20, and a liquid crystal layer 15 (refer to FIG. 2) filled between the two display panels 10 and 20. At least one polarizer that polarizes light may be attached to an outer surface of the display unit 400.

The signal controller 100 receives image signals R, G, and B and an input control signal controlling displaying thereof. The input control signal includes a data enable signal DE, a horizontal synchronizing signal Hsync, a vertical synchronization signal Vsync, and a main clock signal MCLK.

The signal controller 100 transmits an image data signal DAT and a data control signal CONT2 to the data driver 300. The data control signal CONT2 is a signal controlling operation of the data driver 300, which includes a horizontal synchronization start signal STH that indicates start of transmission of the image data signal DAT, and a load signal LOAD and a data clock signal HCLK instructing an output of a gray voltage to the plurality of data lines D1 to Dm. The data control signal CONT2 may further include an inverse signal RVS that inverts voltage polarity of the image data DAT with respect to the common voltage Vcom.

The signal controller 100 transmits the scan control signal CONT1 to the scan driver 200. As a signal that controls operation of the scan driver 200, the scan control signal CONT1 may include a scan start signal STV in the scan driver 200 and at least one clock signal CKV controlling output of a gate-on voltage. The scan control signal CONT1 may further include an output enable signal OE that limits duration of the gate-on voltage.

The data driver 300 is connected to the plurality of data lines D1 to Dm arranged in the display unit 400, and selects a gray voltage corresponding to an image data signal DAT from the gray voltage generator 350. The data driver 300 applies the selected gray voltage to the data lines D1 to Dm.

The gray voltage generator 350 may provide a set or determined number of reference gray voltages to the data driver 300 rather than providing voltages with respect to all grays. In this case, the data driver 300 generates gray voltages for all grays by dividing the reference gray voltage and selects a data voltage from the gray voltages.

Here, the gray voltage generator 350 is provided separately from the data driver 300, but exemplary embodiments of the present invention are not limited thereto, and the gray voltage generator 350 may be included in the data driver 300.

The scan driver 200 is connected to the plurality of scan lines S1 to Sn arranged in the display unit 400, and applies a scan signal, which is combination of a gate-on voltage that turns on a switching element Q (refer to FIG. 2) and a gate-off voltage that turns off the switching element, to the plurality of scan lines S1 to Sn. The scan driver 200 may sequentially apply a scan signal of the gate-on voltage to the plurality of scanning lines S to Sn.

The power supply 500 provides a power voltage VSS for generation of scan signals of the gate-on signal and the gate-off signal to the scan driver 200. The power voltage VSS may be a reference voltage for generation of the scan signals of the gate-on voltage and the gate-off voltage. In addition, the power supply 500 may provide power for driving of the signal controller 100 and the data driver 300.

The short detector 600 generates enable signals EN1 and EN2 by detecting a voltage level of the power voltage VSS. The enable signals EN1 and EN2 include at least one of a first enable signal EN1 transmitted to the signal controller 100 and a second enable signal EN2 transmitted to the power supply 500.

The short detector 600 may output the enable signals EN1 and EN2 of a first-level voltage when it detects that the power voltage VSS is within a set or determined voltage range, and may output the enable signals EN1 and EN2 of a second-level voltage when it detects that the power voltage VSS is outside of the set or determined voltage range.

The first enable signal EN1 of the first-level voltage is a signal that activates the signal controller 100, and the first enable signal EN1 of the second-level voltage is a signal that deactivates the signal controller 100. That is, when the first enable signal EN1 represents the first-level voltage, the signal controller 100 is activated and operated, and when the first enable signal EN1 represents the second-level voltage, the signal controller 100 is deactivated and not operated.

The second enable signal EN2 of the first-level voltage is a signal that activates the power supply 500, and the second enable signal EN2 of the second-level voltage is a signal that deactivates the power supply 200. That is, when the second enable signal EN2 represents the first-level voltage, the power supply 500 is activated and operated, and when the second enable signal EN2 represents the second-level voltage, the power supply 500 is deactivated and not operated.

The signal controller 100, the scan driver 200, the data driver 300, the gray voltage generator 350, the power supply 500, and the short detector 600 may be respectively disposed in at least one of following forms: at least one integrated circuit chip format mounted to the display unit 400, a flexible printed circuit film mounted to the display unit 400, a tape carrier package attached to the display unit 400, and mounted to an additional printed circuit board. The signal controller 100, the scan driver 200, the data driver 300, the gray voltage generator 350, the power supply 500, and the short detector 600 may also be integrated with the display unit 400 together with the plurality of scanning lines S1 to Sn and the plurality of data lines D1 to Dm.

For example, the scan driver 200 may be disposed onto the display unit 400 by an amorphous silicon gate (ASG). Also, the data driver 300 may be disposed as a driving IC in which a function of the signal controller 100 is installed.

Figure 2:
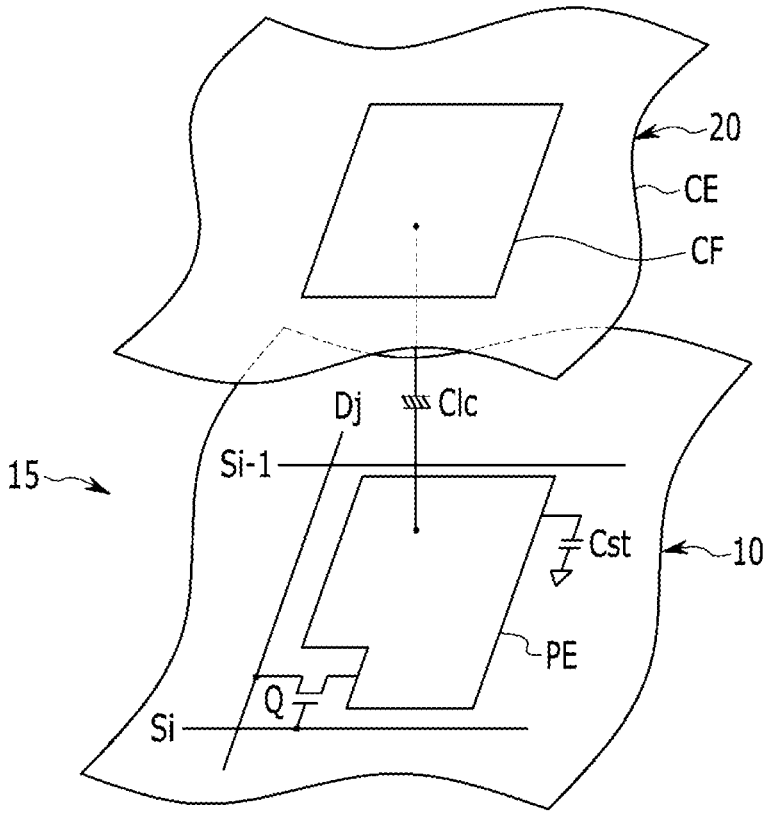
FIG. 2 is an equivalent circuit diagram of one pixel of the display device according to the exemplary embodiment of the present invention.

FIG. 2 is an equivalent circuit diagram of one pixel of the display device according to the exemplary embodiment of the present invention.

Referring to FIG. 2, the exemplary pixel PX of the display unit 400 is illustrated to be connected to an i-th scan line Si and an j-th data line Dj($1<i\leq n$, $1\leq j\leq m$). The pixel PX includes a switching element Q, a liquid crystal capacitor Clc connected to the switching element Q, and a storage capacitor Cst.

The switching element Q is a three-terminal element, such as a thin film transistor, provided in the thin film transistor array panel 10. The switching element Q includes a gate terminal connected to corresponding one of the plurality of scanning lines S1 to Sn, which is Si in the present exemplary embodiment, an input terminal connected to corresponding one of the plurality of data lines D1 to Dm, which is Dj in the present exemplary embodiment, and an output terminal connected to the storage capacitor Cst. The thin film transistor includes amorphous silicon or polysilicon.

The thin film transistor may be an oxide thin film transistor, including a semiconductor layer is made of an oxide semiconductor.

The oxide semiconductor may include at least one of oxide based on titanium (Ti), hafnium (Hf), zirconium (Zr), aluminum (Al), tantalum (Ta), germanium (Ge), zinc (Zn), gallium (Ga), tin (Sn), and indium (In), and complex oxides thereof, such as zinc oxide (ZnO), indium-gallium-zinc oxide ($InGaZnO_4$), indium zinc oxide (In—Zn—O), zinc-tin oxide (Zn—Sn—O), indium gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium gallium oxide (In—Ge—Ga—O), titanium-indium-zinc oxide (Ti—In—Zn—O), and hafnium-indium-zinc oxide (Hf—In—Zn—O).

The semiconductor layer includes a channel area in which impurities are not doped, and a source area and a drain area in which impurities are doped at respective sides of the channel area. Herein, the impurities vary according to a kind of thin film transistor, and may be N-type impurities or P-type impurities.

When the semiconductor layer is formed of the oxide semiconductor, a separate passivation layer may be included to provide protection to the oxide semiconductor which may be vulnerable from the external environment such as exposure to a high temperature.

The liquid crystal capacitor Clc includes a pixel electrode PE disposed on the thin film transistor array panel 10 and a common electrode CE disposed on the common electrode panel 20 as two terminals, and the liquid crystal layer 15 disposed as a dielectric material between the pixel electrode PE and the common electrode CE. The liquid crystal layer 15 has dielectric anisotropy.

The pixel electrode PE is connected to the switching element Q, and the common electrode CE is formed on the whole surface of the common electrode panel 20 and receives the common voltage Vcom. The common electrode CE also may be disposed on the thin film transistor array panel 10, and in this case, at least one of either the two electrodes PE and CE may be formed in the shape of a line or a bar.

The storage capacitor Cst is configured as an auxiliary to the liquid crystal capacitor Clc and is formed or disposed where a separate signal line provided on the lower panel 100 and the pixel electrode 191 are overlapping each other with an insulator therebetween, and a common voltage Vcom is applied to the separate signal line.

A color filter CF may be formed as or disposed on a part of the common electrode CE of the common electrode panel 20. Each pixel PX may be set to uniquely display one of primary colors and to display a desired color. Each of the pixels PX alternately displays one of the primary colors according to time to display desired color by the spatial and temporal sum of the primary colors. For example, the primary colors may include three primary colors such as red, green, and blue.

Here, as an example of the spatial division, each pixel PX is provided with a color filter CF that represents one of the primary color in an area of the common electrode display panel 20 corresponding to the pixel electrode PE. However, the color filter may be provided above or below the pixel electrode PE of the thin film transistor array panel 10.

Figure 3:
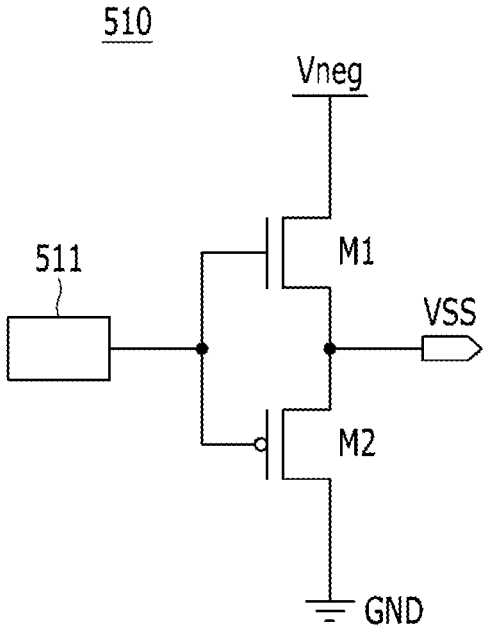
FIG. 3 is a circuit diagram of a power generator generating a VSS power voltage according to the exemplary embodiment of the present invention.

FIG. 3 is a circuit diagram of the power generator generating the power voltage VSS according to the exemplary embodiment of the present invention.

Referring to FIG. 3, the power supply 500 includes a power generator 510 generating the power voltage VSS supplied to the scan driver 200.

The power generator 510 includes a switching controller 511, a first transistor M1, and a second transistor M2.

The first transistor M1 includes a gate electrode connected to the switching controller 511, a first electrode connected to a base voltage Vneg, and a second electrode connected to a first electrode of second transistor M2. The ground voltage Vneg may be lower than a ground voltage GND. That is, the base voltage Vneg may be a negative voltage.

The second transistor M2 includes a gate electrode connected to the switching controller 511, the first electrode connected to the second electrode of the first transistor M1, and a second electrode connected to the ground voltage GND.

An output end is connected between the first transistor M1 and the second transistor M2, and a voltage between first transistor M1 and the second transistor M2 is transmitted as the power voltage VSS to the output end.

The first transistor M1 and the second transistor M2 are different channel transistors. The first transistor M1 may be an n-channel electric field effect transistor and the second transistor M2 may be a p-channel electric field effect transistor. A gate-on voltage to turn on the n-channel electric field effect transistor is a low-level voltage and a gate-off voltage to turn off the n-channel electric field effect transistor is a high-level voltage. Also, a gate-on voltage to turn on the p-channel electric field effect transistor is a low-level voltage and a gate-off voltage to turn off the p-channel electric field effect transistor is a high-level voltage.

The switching controller 511 controls turn-on/off of the first and second transistors M1 and M2. The switching controller 511 alternately applies a high-level voltage and a low-level voltage to the gate electrode of the first transistor M1 and the gate electrode of the second transistor M2 to alternately turn on the first transistor M1 and the second transistor M2 such that a level of the power voltage VSS transmitted to the output end can be controlled. When the first transistor M1 is turned on, the base voltage Vneg is connected to the output end, and when the second transistor M2 is turned on, the ground voltage GND is connected to the output end. Accordingly, the power voltage VSS may be output as a voltage having a level between the base voltage Vneg and the ground voltage GND. The switching controller 511 can control the level of the power voltage VSS by properly controlling a time of application of the high-level voltage and the low-level voltage. For example, the power voltage VSS may be a set voltage within a range of −7 V to −11 V, and in this case, the base voltage Vneg becomes a lower voltage than −11 V.

In the exemplary embodiment of the present invention, the first transistor M1 is the n-channel electric field effect transistor and the second transistor M2 is the p-channel electric field effect transistor, but the first transistor M1 may be the p-channel electric field effect transistor and the second transistor M2 may be the n-channel electric field effect transistor.

Figure 4:
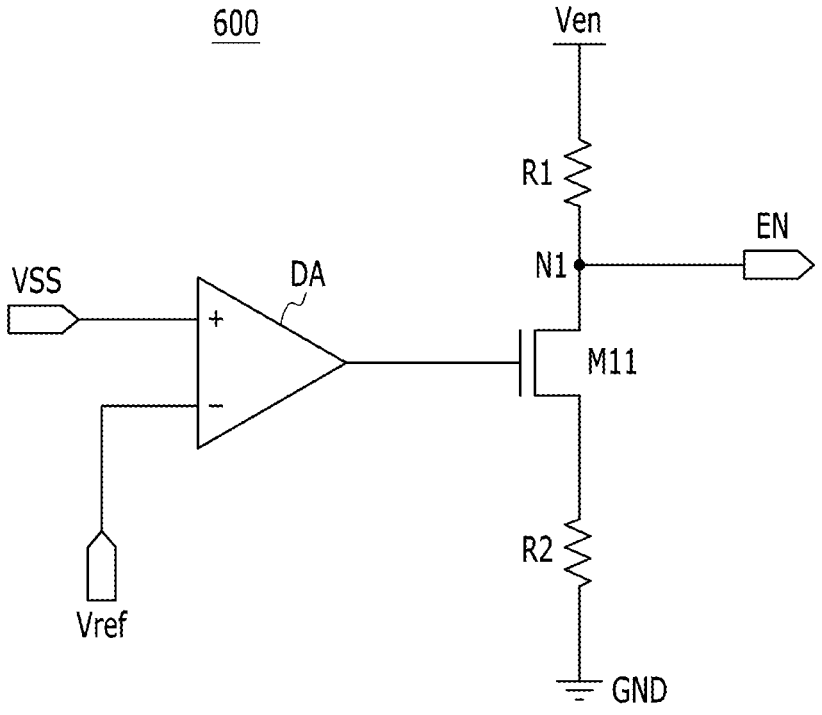
FIG. 4 is a circuit diagram of a short detector according to the exemplary embodiment of the present invention.
Figure 5:
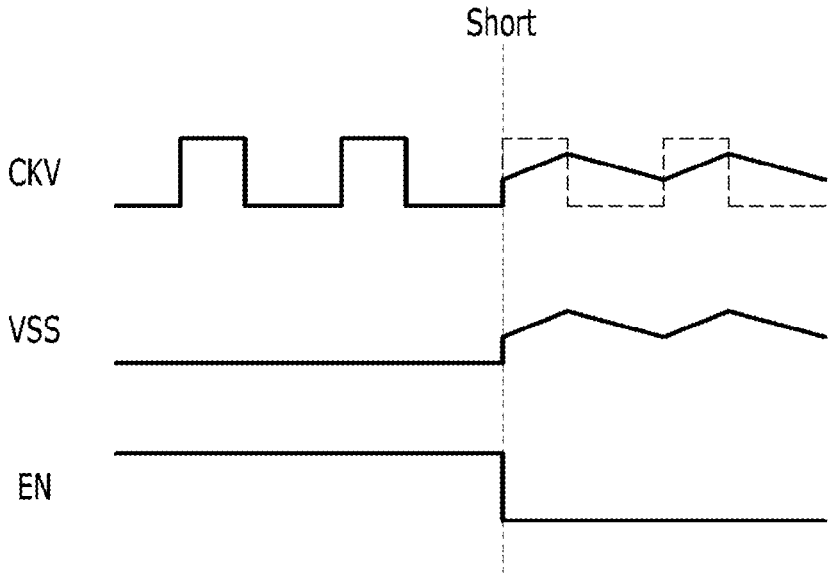
FIG. 5 is a timing diagram of a driving method of a display device according to an exemplary embodiment of the present invention.

FIG. 4 is a circuit diagram of the short detector according to the exemplary embodiment of the present invention. FIG. 5 is a timing diagram of a driving method of a display according to an exemplary embodiment of the present invention.

Referring to FIG. 4 and FIG. 5, the short detector 600 includes a differential amplifier DA, a switching transistor M11, a first resistor R1, and a second resistor R2.

The differential amplifier DA includes a first input terminal (+), a second input terminal (−), and an output terminal. The power voltage VSS output from the power generator 510 is input to the first input terminal (+), the reference voltage Vref is input to the second input terminal (−), and an output voltage corresponding to a difference between the power voltage VSS and the reference voltage Vref is transmitted to the output terminal.

The reference voltage Vref may be a voltage having a set voltage difference from a normal power voltage VSS. The reference voltage Vref may also have the same voltage as the normal power voltage VSS. For example when the normal power voltage is −7 V, the reference voltage Vref may be set to a voltage that is higher by about 0.5 V than the power voltage VSS. In such a case, an output voltage output from the differential amplifier DA is output as a negative voltage.

The switching transistor M11 includes a gate electrode connected to the output terminal of the differential amplifier DA, a first electrode connected to a first node N, and a second electrode connected to the second resistor R2. The switching transistor M11 is turned on by the output voltage of the differential amplifier DA applied to the gate electrode and electrically connects the first node N1 to the ground voltage GND.

Here, the switching transistor M11 is assumed to be an n-channel electric field effect transistor. However, the switching transistor M11 may be a p-channel electric field effect transistor, and in this case, the switching transistor M11 may be driven by a voltage having opposite polarity to that of the n-channel electric field effect transistor.

The first resistor R1 is connected between the enable voltage Ven from the short detector (not shown) and the first node N. The enable voltage Ven may be a high-level voltage that is higher than the ground voltage GND.

The second resistor R2 is connected between the switching transistor M11 and the ground voltage GND. The ground voltage GND may be substantially 0 V.

An enable output terminal is connected to the first node N, and a voltage of the first node N1 is transmitted as an enable signal EN to the enable output terminal. The voltage of the first node N1 fluctuates according to the turn-on/off state of the switching transistor M11. The turn-on/off state of the switching transistor M11 is determined by the power voltage VSS input to the differential amplifier DA.

When the power voltage VSS is input with a normal level to the differential amplifier DA, the output voltage of the differential amplifier DA is output as a negative voltage, that is, a gate-off voltage that turns off the switching transistor M11. When the switching transistor M11 is turned off by the output voltage of the gate-off voltage, the voltage of the first node N1 becomes a high-level voltage from the enable voltage Ven which is a high-level voltage. That is, an enable signal EN of a high-level voltage is output to the enable output terminal.

As shown in FIG. 5, the normal power voltage VSS is output as a low-level voltage, and in this case, the clock signal CKV has a waveform alternatingly fluctuating between a high-level voltage and a low-level voltage, and the enable voltage EN has a high-level voltage.

When a short circuit occurs between wiring of the power voltage VSS and wiring of the clock signal CKV, the power voltage VSS is increased than its original voltage level, and the clock signal CKV also fluctuates according to the waveform, not transmitting a normal waveform. When the power voltage VSS is increased to more than the original voltage level and is then input to the differential amplifier DA, the output voltage of the differential amplifier DA transmits a positive voltage as a gate-on voltage that turns on the switching transistor M11. When the switching transistor M11 is turned on by the output voltage of the gate-on voltage, a current flows to the ground voltage GND and the voltage of the first node N1 becomes a low-level voltage. Therefore, an enable signal EN of a low-level voltage is transmitted to the enable output terminal.

The enable signal EN includes a first enable signal EN1 transmitted to the signal controller 100 and a second enable signal EN2 transmitted to the power supply 500.

When the first enable signal EN1 is changed from a high-level voltage to a low-level voltage, the signal controller 100 stops operating. When the second enable signal EN2 is changed from a high-level voltage to a low-level voltage, the power supply 500 stops operating. When at least one of the signal controller 100 and the power supply 500 stops operating, operating of the display device is stopped. Thus, an excessive short circuit current between the wiring of the power voltage VSS and the wiring of the clock signal CKV and ignition of the short circuit wire due to an excessive amount of current can be mitigated.

In the above description, the exemplary embodiments of present invention may mitigate malfunction of the display device by detecting a short circuit between the wiring of the power voltage VSS and the clock signal CKV in a liquid crystal display. The exemplary embodiments of present invention may be applied not only to the liquid crystal display but also to different types of display devices, and may also be applied to mitigate a problem such as a short circuit between wiring of various electronic devices and ignition of the short circuited wire due to an excessive amount of current.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a plurality of pixels;

a scan driver configured to apply a scan signal to a plurality of scan lines connected to the plurality of pixels;

a data driver configured to apply a gray voltage to a plurality of data lines connected to the plurality of pixels;

a signal controller configured to transmit a scan control signal for controlling operation of the scan driver to the scan driver, and configured to transmit a data control signal for controlling operation of the data driver to the data driver;

a power supply configured to supply a power voltage provided for generation of the scan signal to the scan driver; and a short detector configured to detect a voltage level of the power voltage and generate an enable signal in response to the detection.

2. The display device of claim 1, wherein the enable signal comprises a first enable signal transmitted to the signal controller, and the signal controller is further configured to be activated when the first enable signal is at a first level voltage and be deactivated when the first enable signal is at a second level voltage.

3. The display device of claim 1, wherein the enable signal comprises a second enable signal transmitted to the power supply, and the power supply is further configured to be activated when the second enable signal is at a first level voltage and be deactivated when the first enable signal is at a second level voltage.

4. The display device of claim 1, wherein the enable signal comprises a first enable signal transmitted to the signal controller and a second enable signal transmitted to the power supply.

5. The display device of claim 4, wherein the signal controller is further configured to operate when the first enable signal is at a first level voltage and to not operate when the first enable signal is at a second level voltage.

6. The display device of claim 4, wherein the power supply is further configured to operate when the second enable signal is at a first level voltage and to not operate when the first enable signal is at a second level voltage.

7. The display device of claim 1, wherein the short detector comprises:

a differential amplifier configured to transmit an output voltage to a first node, wherein the output voltage corresponds to a difference between the power voltage and a reference voltage;

a first resistor connected between the short detector and the first node;

a second resistor comprising a first electrode connected to a ground voltage; and a switching transistor comprising a gate electrode to which the output voltage is applied, a first electrode connected to the first node, and a second electrode connected to the second resistor.

8. The display device of claim 7, wherein the reference voltage is configured to have a voltage difference from a normal voltage of the power voltage.

9. The display device of claim 7, wherein the differential amplifier is configured to transmit a gate-off voltage as the output voltage, the gate-off voltage to turn off the switching transistor, in response to the power voltage with a normal voltage level being transmitted to the differential amplifier.

10. The display device of claim 9, wherein, the short detector is further configured to transmit an enable signal of a first level voltage as a voltage of the first node, the first level voltage activating at least one of the signal controller and the power supply, when the switching transistor is turned off.

11. The display device of claim 7, wherein the differential amplifier is configured to transmit a gate-on voltage as the output voltage, the gate-on voltage to turn on the switching transistor, when the power voltage is not within a voltage range is transmitted to the differential amplifier.

12. The display device of claim 11, wherein, the short detector is further configured to transmit an enable signal of a second level voltage as a voltage of the first node, the second level voltage deactivating at least one of the signal controller and the power supply, when the switching transistor is turned on.

13. The display device of claim 11, wherein the scan control signal comprises at least one clock signal, and the short detector is configured to detect a short circuit between wiring of the power voltage and wiring of the clock signal from the power voltage received when the received power voltage is not within a set voltage range.

14. A method for driving a display device, comprising:

receiving a power voltage for generating a scan signal applied to a plurality of scan lines connected to a plurality of pixels;

generating an output voltage corresponding to a voltage difference between the power voltage and a reference voltage;

controlling the switching transistor according to the output voltage; and transmitting a voltage of a first node between the switching transistor and an enable voltage as an enable signal to at least one of a power supply configured to generate the power voltage and a signal controller configured to control operation of the scan.

15. The method for driving the display device of claim 14, wherein the reference voltage has a voltage difference from the power voltage within a voltage range.

16. The method for driving the display device of claim 14, wherein the generating the output voltage comprises transmitting the output voltage as a gate-off voltage, which turns off the switching transistor, when the power voltage is within a voltage range.

17. The method for driving the display device of claim 16, wherein a voltage of the first node is output as an enable signal of a first-level voltage that activates at least one of the signal controller and the power supply.

18. The method for driving the display device of claim 14, wherein the generating the output voltage comprises transmitting the output voltage as a gate-on voltage, which turns on the switching transistor, when the power voltage is not within a voltage range.

19. The method for driving the display device of claim 18, wherein the voltage of the first node is output as an enable signal of a second level voltage that deactivates at least one of the signal controller and the power supply.

20. The method for driving the display device of claim 19, further comprising stopping operation of at least one of the signal controller and the power supply according to the enable signal of the second level voltage.

* * * * *